US005573230A

United States Patent [19]

Lambertini

[11] Patent Number: 5,573,230

[45] Date of Patent: Nov. 12, 1996

[54] DEVICE FOR BLOCKING A PIECE ON A SUPPORT PLANE LIKE A TABLE FOR OPERATING MACHINES

[75] Inventor: Giuseppe Lambertini, Settimo Milanese, Italy

[73] Assignee: Officina Meccanica Lombarda S.R.L., Travaco' Siccomario, Italy

[21] Appl. No.: 378,731

[22] Filed: Jan. 26, 1995

[51] Int. Cl.$^6$ ..... B25B 1/08

[52] U.S. Cl. ..... 269/235; 269/305

[58] Field of Search ..... 269/303, 305, 269/315, 229–237, 99–100

[56] References Cited

U.S. PATENT DOCUMENTS 449,039 3/1891 Fietsch ..... 269/235

4,477,064 10/1984 DiGiulio ..... 269/235

4,805,888 2/1989 Bishop ..... 269/235

4,915,367 4/1990 Carossino ..... 269/235

*Primary Examiner*—Robert C. Watson

*Attorney, Agent, or Firm*—Watson Cole Stevens Davis, P.L.L.C.

[57] ABSTRACT

The device comprises: a central pin (18) provided with means (23, 34) for its blocking to the support plane (10) axis A of the pin (18) perpendicular to the plane itself; an anular hub (20), freely rotating around the pin (18), provided with driving means (60) for its rotation and having a peripherical male screw cutting eccentric in relation to the axis of the pin (18); and a ring nut (22) having an internal screw cutting (52) coupled to the external screw cutting of the hub (20) and presenting on into periphery at least a face (54, 56) for laterally engaging the piece (W), like a thightening jaw, the coupled screw cuttings of the hub (20) and of the ring nut (22) having an irreversible pitch (FIG. 2 ).

20 Claims, 3 Drawing Sheets

DEVICE FOR BLOCKING A PIECE ON A SUPPORT PLANE LIKE A TABLE FOR OPERATING MACHINES

The present invention refers to a device for blocking a piece on a support plane, like a table for an operating machine or for similar applications.

The object of the present invention is the realization of a device of this type having a simple and solid structure and of general employment, such as to permit, in cooperation with similar devices, the secure blocking of pieces having the most varied, even irregular, shapes. According to the invention, this object is obtained by means of a device similar to the consedered type, characterized by the fact that it comprises:

- a central pin provided with means for its secure blocking to the support plane with the axis of the pin perpendicular to the plane itself;
- an anular hub, freely rotating around the pin, provided with driving means for its rotation and having a peripheric ai male screw cuttingeccentric in relation to the axis of the pin; and
- a ring nut having an internal screw cutting, coupled to the external screw cutting of the hub and presenting on its periphery at least a face for laterally engaging the piece, like a thightening jaw, the coupled screw cuttings of the hub and of the ring nut having an irreversible pitch.

Figure 2:
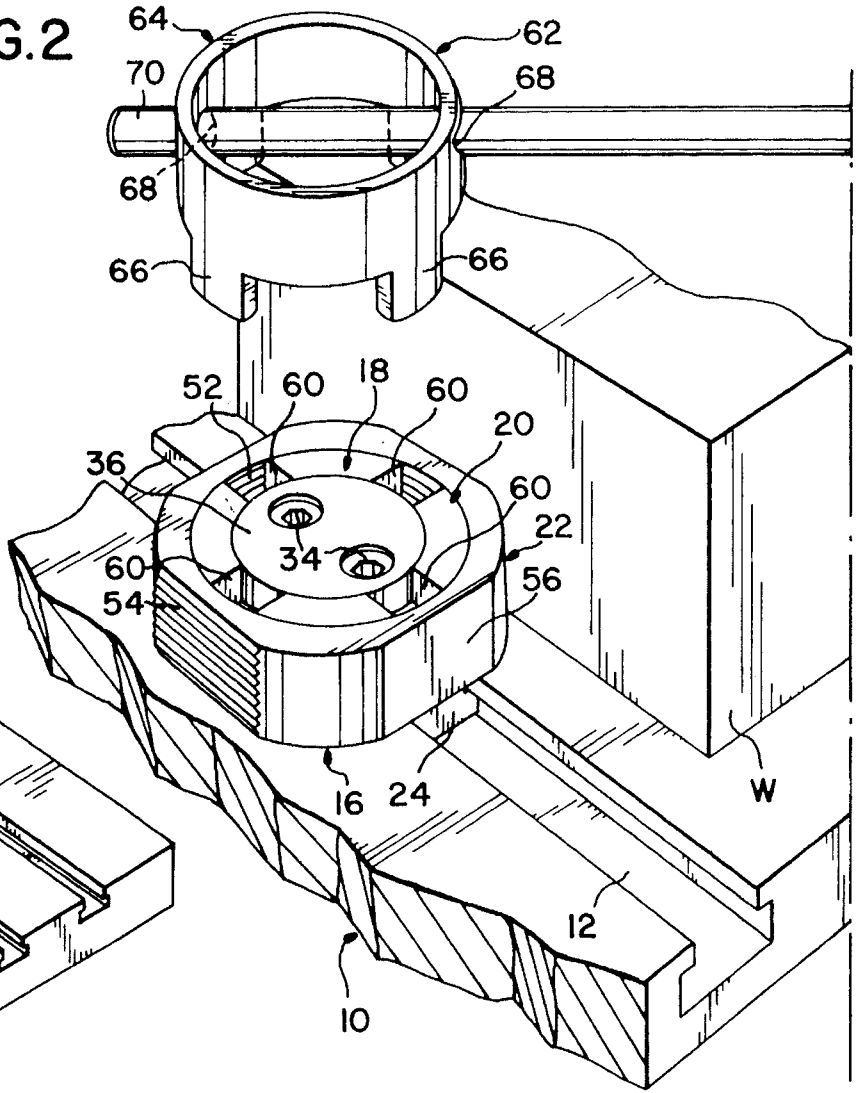
Figure 1:
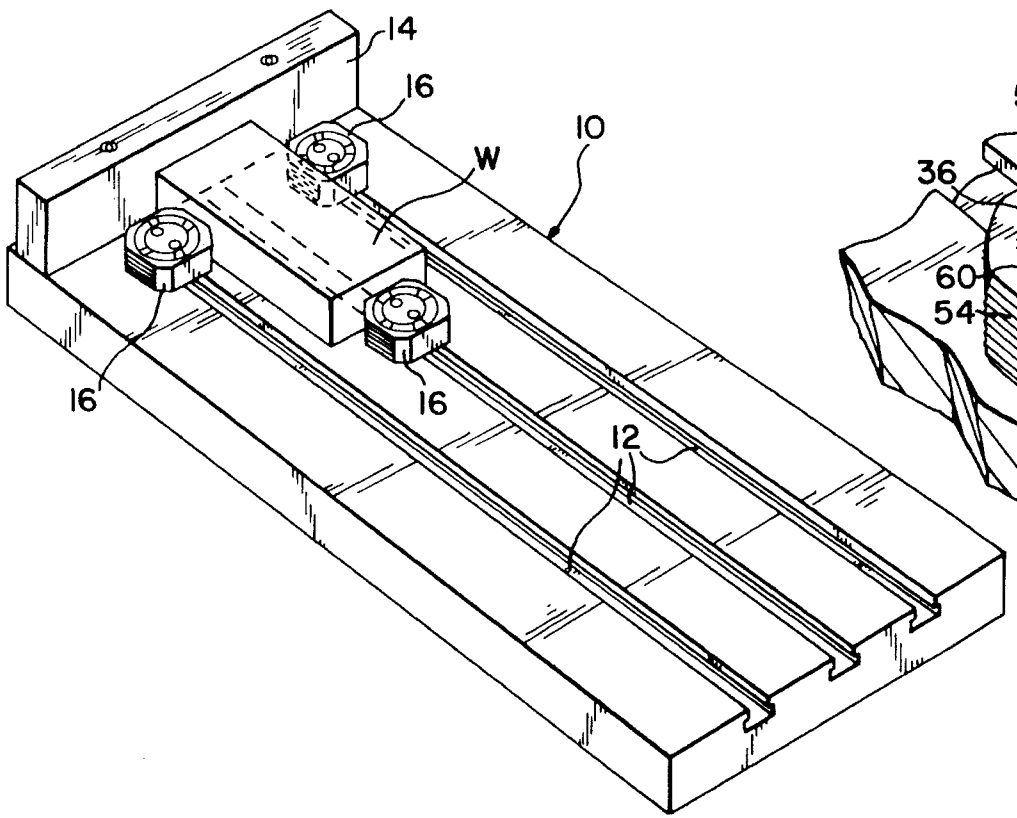
Figure 3:
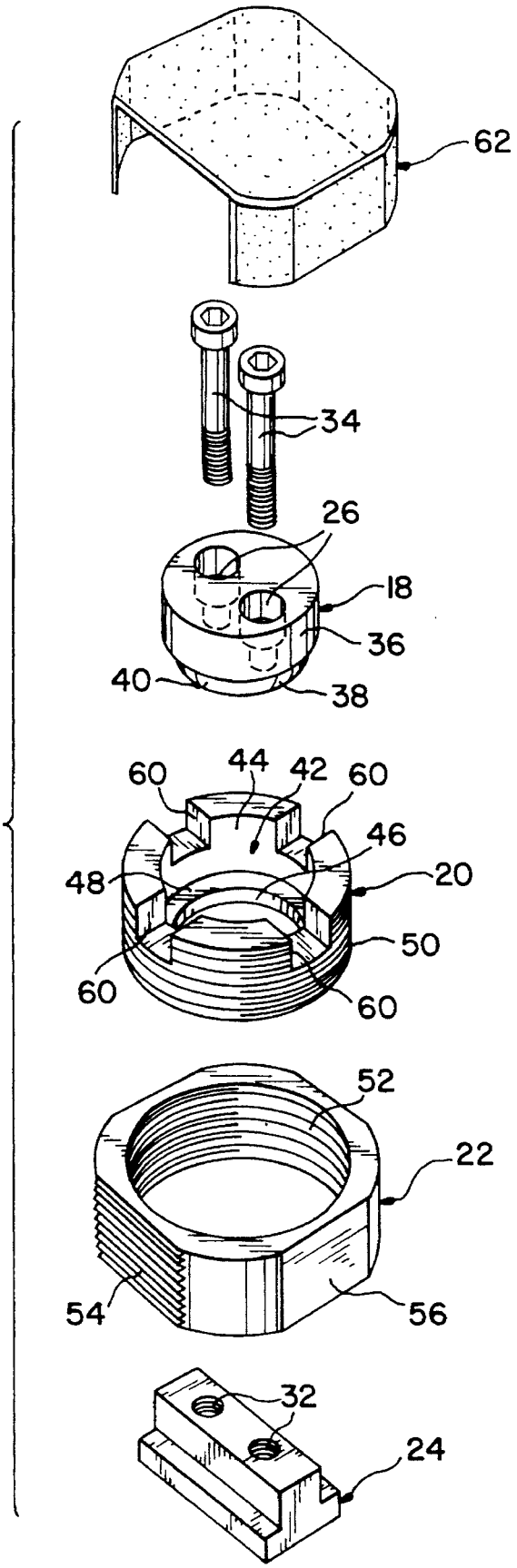
Figure 4:
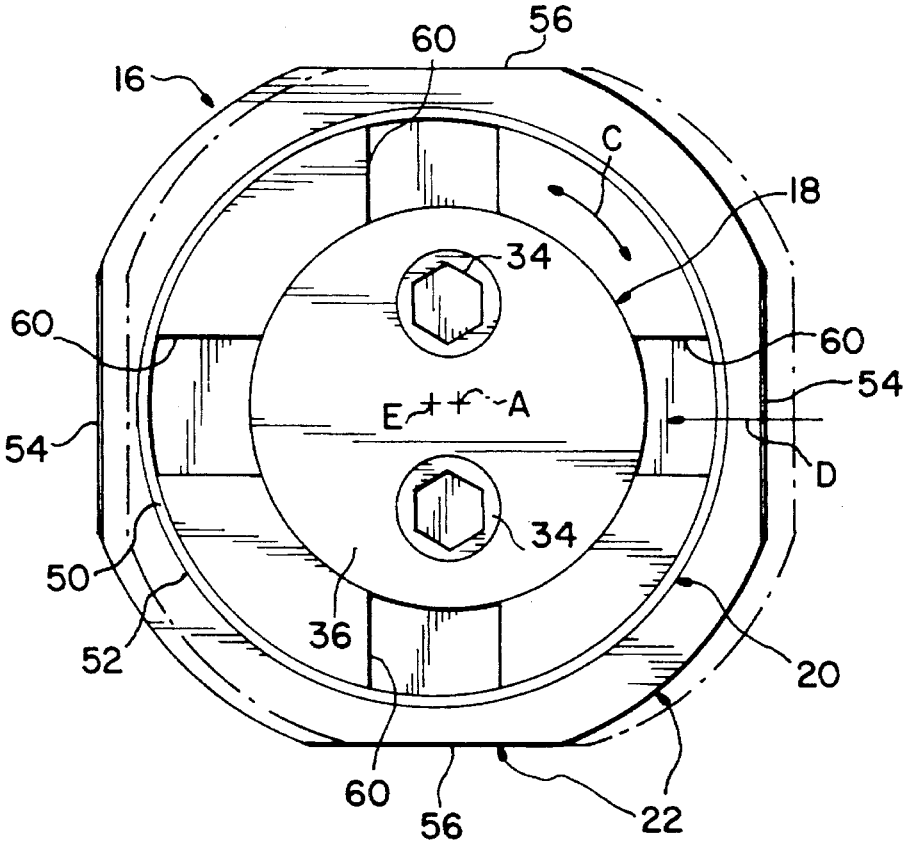
Figure 5:
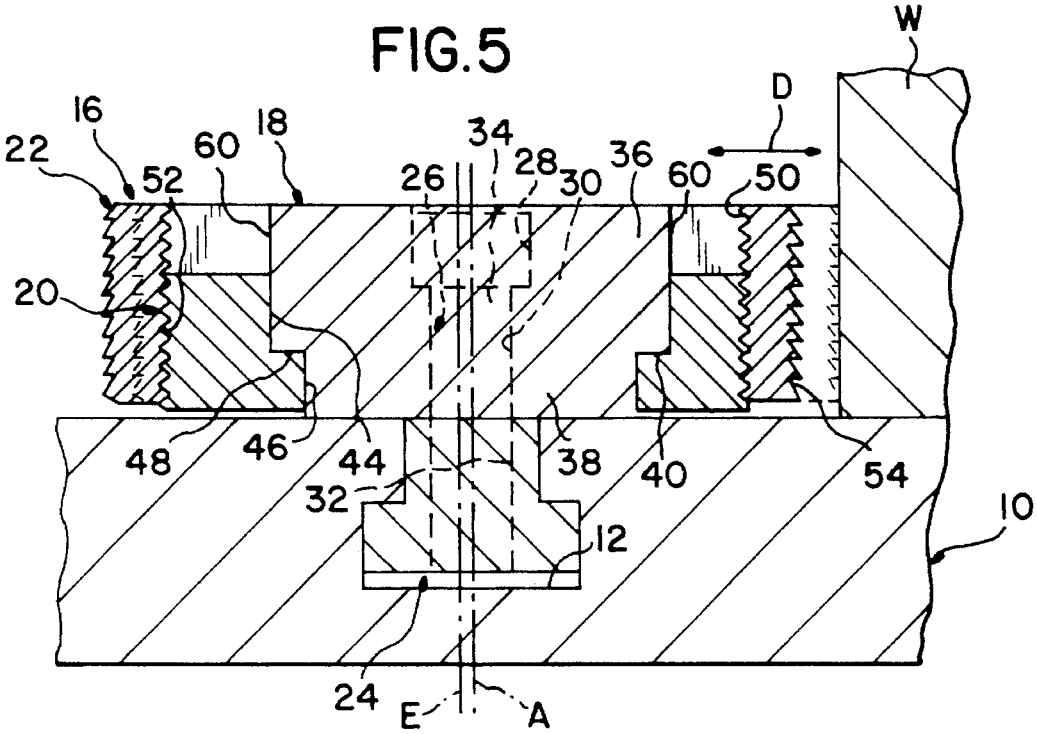

The characteristics and advantages of the present invention will become more apparent from the following description of the preferred embodiment of the invention described in connection with the accompanying drawings in which:

FIG. 1 is a perspective view illustrating a table for operating machine on which a piece to be worked is fixed by blocking means according to the invention;

FIG. 2 is a perspective, in large scale view, of a position of FIG. 1, in which one of the blocking devices and one corresponding control key, of the same devices are illustrated, FIG. 3 ia a view in exploded perspective of the blocking device and of its protective cap, FIG. 4 is a plan view of the blocking device, and FIG. 5 is a diametral sectional view in association with the table and the piece, partially represented.

With reference to FIG. 1, a table for an operating machine, indicated in the whole with 10, presents the ordinary T-Shaped fixing grooves, indicated with 12. Checking means, fixed to the table 10, are designed with 14.

A piece to be worked is indicated with W, and is fixed to the table 10 by means of three similar fixing devices, according to the invention, all designed with 16.

The piece W has been conventionally represesented in the form of a prismatic block; but it might have any other shape, even an irregular one.

Referring to the FIGS. 2 to 5, a fixing device 16 comprises a central steel hub 20, free to rotate around the pin 18, and a steel ring nut 22.

A T-shaped steel key 24 is joined to the pin 18, as illustrated in the FIGS. 2 to 5, and is inserted in one of the grooves 12. The pin 18 presents at least a longitudinal passing bore and, preferably, as represented, a couple of these bores, designated as 26 and disposed on a diameter at the same distance from the axis of the pin 18. Each bore 26 comprises (FIG. 5) a blinded portion 28 and a smooth portion 30.

In its turn. the key 24 presents a couple of threaded bores 32. The fixing of the pin 18 to the table 10 occurs by means of a couple of screws 34 of the internal hexagon type. The heads of these screws remain encased in the blinded portions 28, their stems go through the smooth portions of the passing bores 26 and their threaded portions couple with the threaded bores 32 of the key 12.

The pin 18 comprises a cylindrical section of greater diameter 36 and a cylindrical following section of smaller diameter 38, so that it forms a ring-like seat 40 which, by the use, is turned toward the table 10.

In a correspondent way, the hub 20 presents a central bore 42 having cylindrical following portions of greater diameter 44 and smaller diameter 46 respectively. As it is possible to observe in FIG. 5, the portions of greater and smaller diameter of the hub 20 are coupled with the corresponding portions of the pin 18, such as to permit the hub 20 to rotate freely, but precisely, around the axis of the pin 18.

Between the two portions 44 and 46 of the bore 42 a ring-like seat is defined, which co-operates with the seat 40 for confining the hub 20 and preventing its removal from the table 10, when the pin 18 is fixed to the same table.

It is to be observed that the confining of the hub 20 is not studied for pressing the hub against the table 10 when the screws 34 are tightened.

The annular hub 20 has external threads 50. The threads 50 are eccentric to the common rotation axis of the bore 40 and of the pin 18

In the FIGS. 4 and 5, the rotation axis is indicated as A and the axis of the threads 50 is indicated as E. The ring nut 22 which encircles the hub 20 is provided with internal threads 52 coupled with threads of the hub 20.

The same ring nut 22 presents on its periphery at least a flat face to laterally engage the piece W and to tighten it and lock it, in cooperation with the other locking means, like a thightening jaw.

The hub 20 is coupled with ring nut 22 and scrwes with said nut in only one position because in this position it is possible to rotate the hub 20 with the key 62.

The ring nut 22 presents on its periphery at least a face 54 or 56 for laterally engaging the piece W, like a thightening jaw Preferably, as represented, the ring nut 22 presents a plurality of flat engaging faces 54, 56, placed on its periphery. Also prefarably these engaging faces 54, 56 are flat, tangential ones, placed on the periphery of the ring nut 22 at 90° one from the other. Again preferably, two engaging, diametrically opposed faces 54 are knurled, as it is illustrated in the FIGS. 3 and 5, while the other two faces 56 are smooth.

The reason for which certain flat faces, as 54, are knurled and other faces, as 56, are smooth, will be explained afterwards.

For locking a piece like W FIGS. 1, 2 and 5, it is necessary to place one of the faces 54 or 56 against W in cooperation with other ssimilar locking devices 16. This is permitted because of the eccentricity of the hub 20 with repect to axis A.

When each locking device 16 has been fixed regarding the relative grooves 12 (FIG. 1) in a position in which the periphery of the ring nut 22 is a few millimeters away from the piece W, one of the faces 54 or 56 is positioned: opposite the piece W and then hub 20 is rotated around the pin 18.

Prefarably, for causing the rotation of the hub 20, this is provided by rotating driving means which comprise diametral slots 60, which, in the case represented in FIGS. 2 to 5, are oppositely disposed. These diametral slots 60 are cut out of a extremity face of the hub 20 furtherest from the table 10.

The device 16, according to the invention, is provided with a key 62 (FIG. 2) which comprises for example a bush 64 provided with teeth 66 engaging the slots 60. The bush 64 presents diametral opposite slots 68 in which a sliding, slippable control rod may be inserted.

Alternately, the bush 64 might be provided with a lateral lever having the same function of the rod 70.

By means of the key 64, it is possible to cause the hub 20 to rotate clockwise or counterclockwise as indicated by the double arrow C in FIG. 4.

As it is clearly apparent, by means of the rotation of the hub C, it is possible to obtain, due to the eccentricity of the screw cutting 50 of the hub 20, an eccentric movement of the ring nut 22 as indicated by the double arrow D in FIGS. 4 and 5. After having suitably oriented the ring nut 22, it is possible to bring one of the faces 54 or 56 in tight and blocking engagement with a corresponding surface or face of the piece W.

The blocking engagement of one of thefaces 54 or 56 with the piece W is mantained stable by means of the friction of threads 50 of the hub 20 and threads 52 of the ring nut 22.

As it is possible to observe particularly in FIGS. 2, 3 and 5, the two opposite knurled faces 54 of the ring nut 22 present preferably a knurl formed by a set of riflings tangentially oriented in relation to the axis of the ring nut 22. Moreovers again preferably, these riflings have a saw teeth shaped contour with flat sides turned, in the use, towards the table or support plane 10. This saw teeth shaped configuration, so, oriented (FIG. 5), constitutes a guarantee against the detaching of the piece W from the table 10.

The other two flat and smooth faces 56 are utilized for engaging a piece, like W, of tender material for avoiding damage to the surface.

By the use, each blocking device 16 may be advantageously covered by a cap 62, for example of plastic material (FIG. 3) for protecting it from the dust, the chips, the cut oils and so on.

I claim:

1. Device for blocking a piece (W) on a support plane (10), comprising:

a central pin (18) provided with means (24, 34) for securely blocking said pin (18) to said support plane (10) with an axis (A) of the pin (18) perpendicular to the plane itself:

an annular hub (20), freely rotatable around the pin (18), said hub (20) defining a rotatable means (60) for said annular hub (20), said hub (20) having an external screw thread; and a ring nut (22) having an internal screw (52) thread coupleable to said external screw thread of hub (20), said ring nut (22) presenting on its periphery at least a face (54, 56) for rotation about said axis (18) and laterally engaging the piece (W), the threads of said hub (20) and of the ring nut (22).

2. The blocking device according to claims 1, therein the pin (18) presents at least one longitudinal passing bore (26), said locking means of the pin (18) to the support plane (10) comprising a T-shaped key (24), engageable with a T-shaped groove (12) in the support plane (10) and defining at least one threaded bore (32) corresponding to the passing bore (26) of the pin (18) and a screw (34) insenable in the passing bore (26) of the pin (18) and screwable into the threaded bore (32) of the key (24).

3. The blocking device according to claim 1, wherein pin (18) comprises a cylindrical section of greater dimension (36) and a cylindrical following section of smaller diameter (38), such as to form a ring-like support seat (40) positionable toward the support plane (10) and correspondingly hub (20) defines a central bore (42) having cylindrical portions (44, 46) corresponding to the cylindrical portions (36, 38) of the pin (18) so as to define a ring-like support seat (48) cooperating with the support seat (40) for preventing the removal of the hub (20) from the support plane (10) when the pin (18) is fixed to said support plane.

4. The blocking device according to claim 2, wherein pin (18) comprises a cylindrical section of greater dimension (36) and a cylindrical following section of smaller diameter (38), such as to form a ring-like support seat (40) positionable toward the support plane (10) and correspondingly hub (20) defines a central bore (42) having cylindrical portions (44, 46) corresponding to the cylindrical portions (36, 38) of the pin (18) so as to define a ring-like support seat (48) cooperating with the support seat (40) for preventing the removal of the hub (20) from the support plane (10) when the pin (18) is fixed to said support plane.

5. The blocking device according to claim 1, wherein said rotating means for the rotation of the hub (20) comprise diametral slots (60) in a face of hub (20), which is away from said support plane (10) and engageable by corresponding projections (66) of a suitable key (62).

6. The blocking device according to claim 2, wherein said rotating means for the rotation of the hub (20) comprise diametral slots (60) in a face of hub (20), which is away from said support plane (10) and engageable by corresponding projections (66) of a suitable key (62).

7. The blocking device according to claim 3, wherein said rotating means for the rotation of the hub (20) comprise diametral slots (60) in a face of hub (20), which is away from said support plane (10) and engageable by corresponding projections (66) of a suitable key (62).

8. The blocking device according to claim 4, wherein said rotating means for the rotation of the hub (20) comprise diametral slots (60) in a face of hub (20), which is away from said support plane (10) and engageable by corresponding projections (66) of a suitable key (62).

9. The blocking device according to claim 1, wherein said ring nut (22) peripherally defines flat faces (54, 56) to engage said piece.

10. The blocking device according to claim 2, wherein said ring nut (22) peripherally defines flat faces (54, 56) to engage said piece.

11. The blocking device according to claim 3, wherein said ring nut (22) peripherally defines flat faces (54, 56) to engage said piece.

12. The blocking device according to claim 4, wherein said ring nut (22) peripherally defines flat faces (54, 56) to engage said piece.

13. The blocking device according to claim 5, wherein said ring nut (22) peripherally defines flat faces (54, 56) to engage said piece.

14. The blocking device according to claim 6, wherein said ring nut (22) peripherally defines flat faces (54, 56) to engage said piece.

15. The blocking device according to claim 7, wherein said ring nut (22) peripherally defines flat faces (54, 56) to engage said piece.

16. The blocking device according to claim 8, wherein said ring nut (22) peripherally defines flat faces (54, 56) to engage said piece.

17. The blocking device of claim 9, wherein said ring nut (22) presents four flat tangential faces (54, 56) placed at 90° from each adjacent face.

18. The blocking device according to claim 9, wherein at least some of the engageable flat faces (54) are knurled.

19. The blocking device according to claim 18, wherein the knurl of each knurled face (54) is formed by a set of riflings tangentially oriented in relation to the axis of the ring nut (22).

20. The blocking device according to claim 19, wherein the riflings of the knurled face (54) have a saw teeth shaped contour with flat sides mined towards the support plane (10).

* * * * *